US007402078B2

(12) United States Patent
Wan et al.

(10) Patent No.: US 7,402,078 B2
(45) Date of Patent: Jul. 22, 2008

(54) ELECTRICAL CONNECTOR WITH FIRM FRAME FOR MATING WITH CORRESPONDING CONNECTOR

(75) Inventors: Feng Wan, Kunshan (CN); Jin-Kui Hu, Kunshan (CN); Guo-Hua Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/646,793

(22) Filed: Dec. 27, 2006

(65) Prior Publication Data

US 2007/0155240 A1 Jul. 5, 2007

(30) Foreign Application Priority Data

Dec. 29, 2005 (CN) ..... 2005 1 0097348

(51) Int. Cl.
*H01R 13/648* (2006.01)

(52) U.S. Cl. ..... 439/607; 439/607; 439/609

(58) Field of Classification Search ..... 439/607, 439/609

See application file for complete search history.

(56) References Cited

U.S. PATENT DOCUMENTS

| | | | | | |
|---|---|---|---|---|---|
| 5,685,739 | A * | 11/1997 | Davis et al. | ..... | 439/607 |
| 6,139,367 | A * | 10/2000 | Yeh | ..... | 439/609 |
| 6,203,335 | B1 * | 3/2001 | Chang | ..... | 439/79 |
| 6,758,685 | B1 * | 7/2004 | Huang et al. | ..... | 439/79 |
| 6,939,177 | B2 | 9/2005 | Kato | | |
| D524,743 | S * | 7/2006 | Lai | ..... | D13/147 |
| D538,233 | S * | 3/2007 | Wan et al. | ..... | D13/147 |

* cited by examiner

*Primary Examiner*—T. C. Patel
*Assistant Examiner*—Harshad C Patel
(74) *Attorney, Agent, or Firm*—Wei Te Chung

(57) ABSTRACT

An electrical connector (1) includes an insulative housing (10) for receiving a number of contacts (2), and a metal shield (3) enclosing the insulative housing (1). The metal shield includes a first frame (401) and a second frame (402). The first and second frames share a partition wall (403) therebetween. The second frame includes a second bottom face (4023) defining a mating slot. The partition wall has a fixing portion (4032) wedged into the mating slot for ensuring a firm configuration of the second frame (402).

15 Claims, 8 Drawing Sheets

ELECTRICAL CONNECTOR WITH FIRM FRAME FOR MATING WITH CORRESPONDING CONNECTOR

BACKGROUND OF THE INVENTION

1. Field of the Invention

This invention generally relates to an electrical connector, and more particularly to an electrical connector with firm frame for mating with a corresponding connector.

2. Description of the Prior Art

U.S. Pat. No. 6,939,177 B2, discloses a conventional electrical connector which includes an insulative housing, a plurality of contacts retained in the insulative housing, and a metal shield enclosing the insulative housing (seen in FIGS. 16~17 of the prior patent). The metal shield includes a first frame, a second frame and a partition wall separating the first and second frames. The first frame includes a first top wall and a first bottom wall opposite to the first top wall. The second frame includes a second top wall coplanar with the first top wall, and a second bottom wall adjacent to the first bottom wall. The partition wall extends integrally from the first bottom wall. The partition wall includes a protrusion received in a hole defined between the first and second top walls of the metal shield, thereby ensuring the configuration of the first frame. However, the structure of the second frame is not stable enough because the island second bottom not engages with any other part of the first frame. After repeated insertion of the mating connector into the second frame, the second frame subjects to an undesired relative movement to the first frame because of exerted excessive forces. As a result, a distortion occurs in the second frame.

Hence, it is desired to have an electrical connector solving the problem above.

BRIEF SUMMARY OF THE INVENTION

Accordingly, an object of the present invention is to provide an electrical connector mating with a corresponding connector with a firm frame.

In order to attain the objective above, an electrical connector includes an insulative housing for receiving a plurality of contacts, and a metal shield enclosing the insulative housing. The metal shield includes a first frame and a second frame. The first and second frames share a partition wall therebetween. The second frame includes a second bottom face defining a mating slot. The partition wall has a fixing portion wedged into the mating slot for ensuring a firm configuration of the second frame.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
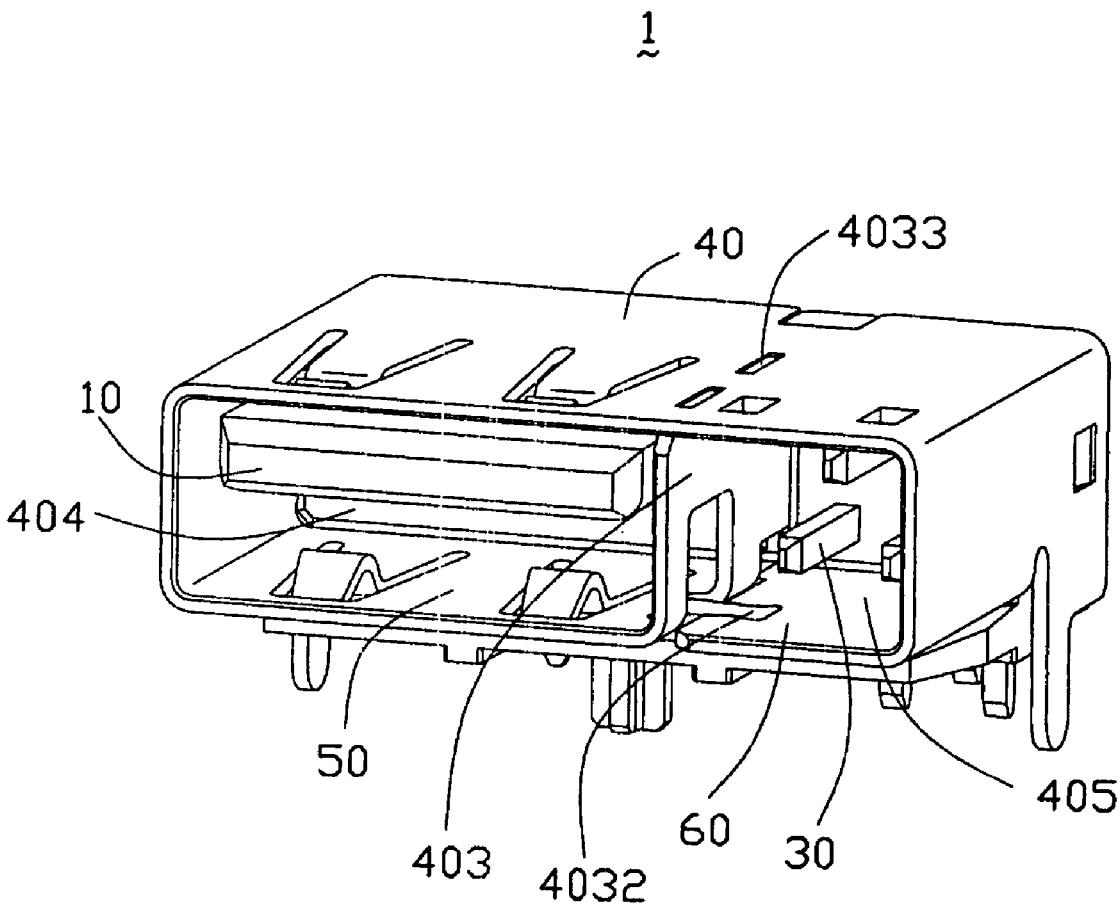
FIG. 1 is a perspective view of an electrical connector according to the present invention.
Figure 2:
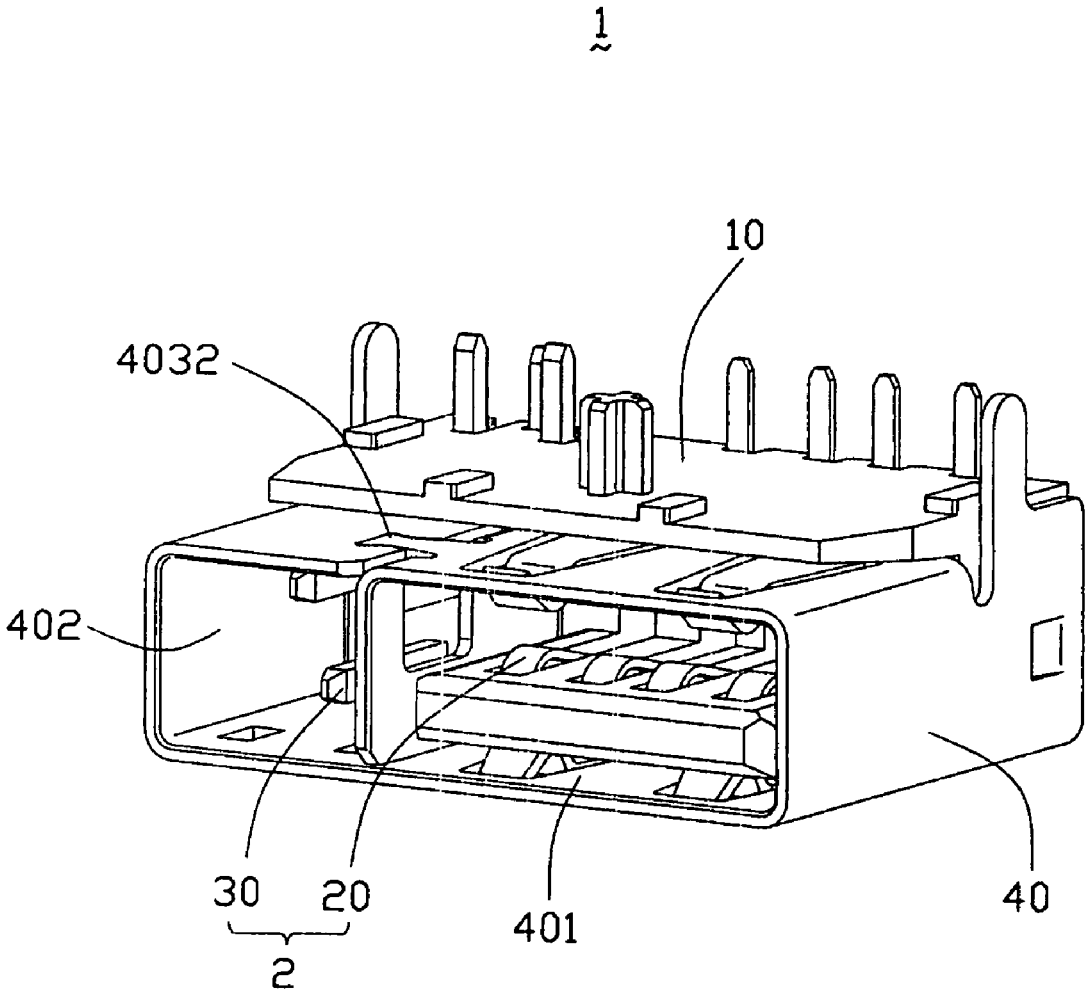
FIG. 2 is a second perspective view of the electrical connector according to the present invention.
Figure 3:
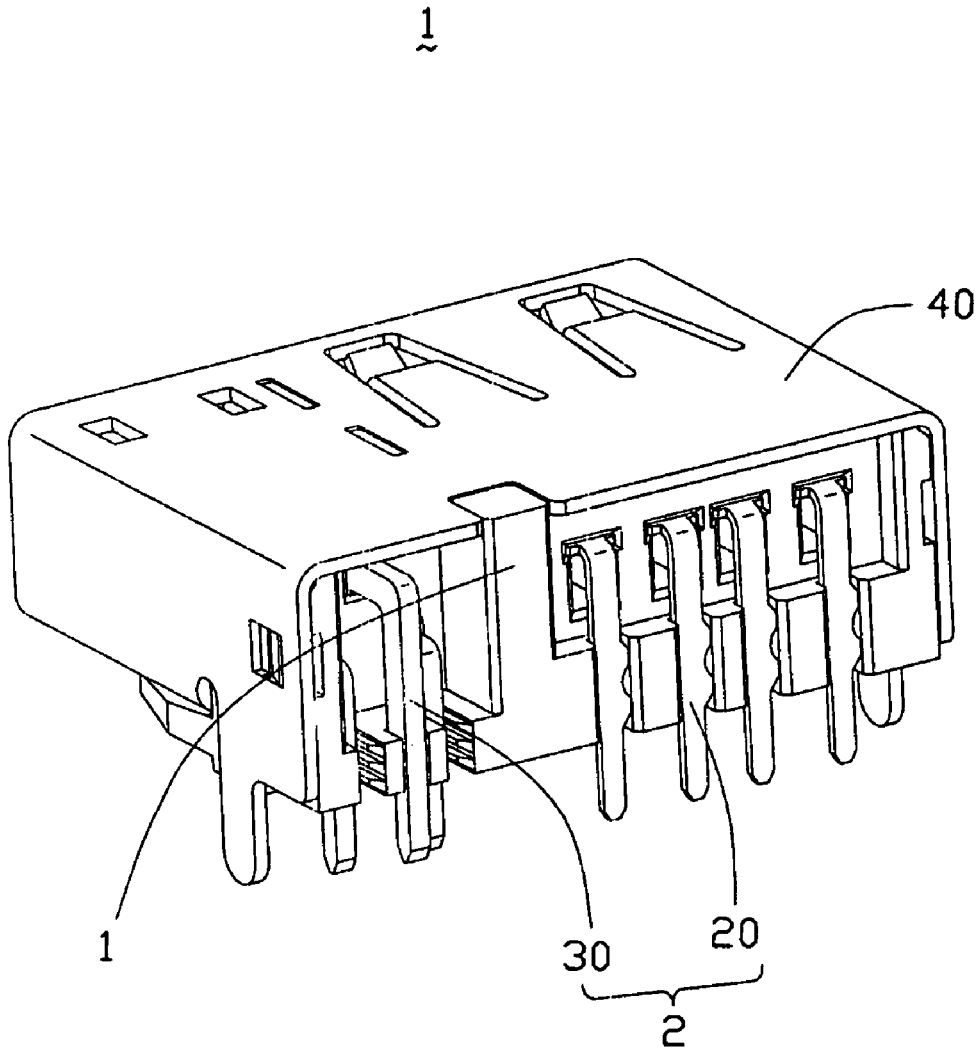
FIG. 3 is a third perspective view of the electrical connector.

Referring to FIGS. 1 to 3, an electrical connector 1 mounted on a printed circuit board (PCB, not shown) comprises an insulative housing 10, a plurality of contacts 2 retained in the insulative housing 10, and a metal shield 40 enclosing the housing 10. The contacts 2 include a plurality of first contacts 20 and second contacts 30. The metal shield 40 includes a first frame 401 and a second frame 402 connecting the first frame 401. The electrical connector 1 includes a first single connector 50 and a second single connector 60 wherein the first and second connectors 50, 60 share the same insulative housing 10 and the metal shield 40. The first single connector 50 is a Universal Serial Bus (USB) connector, which is composed of a part of the housing 10, the first contacts 20 and the first frame 401. The second single connector 60 is a power connector, which is composed of another part of the housing 10, the second contacts 30 and the second frame 402. The first and second frames 401, 402 respectively define first and second chambers 404, 405 formed by peripheral faces. The first and second connectors 40, 50 are located side by side for mating with corresponding connectors (not shown).

Figure 4:
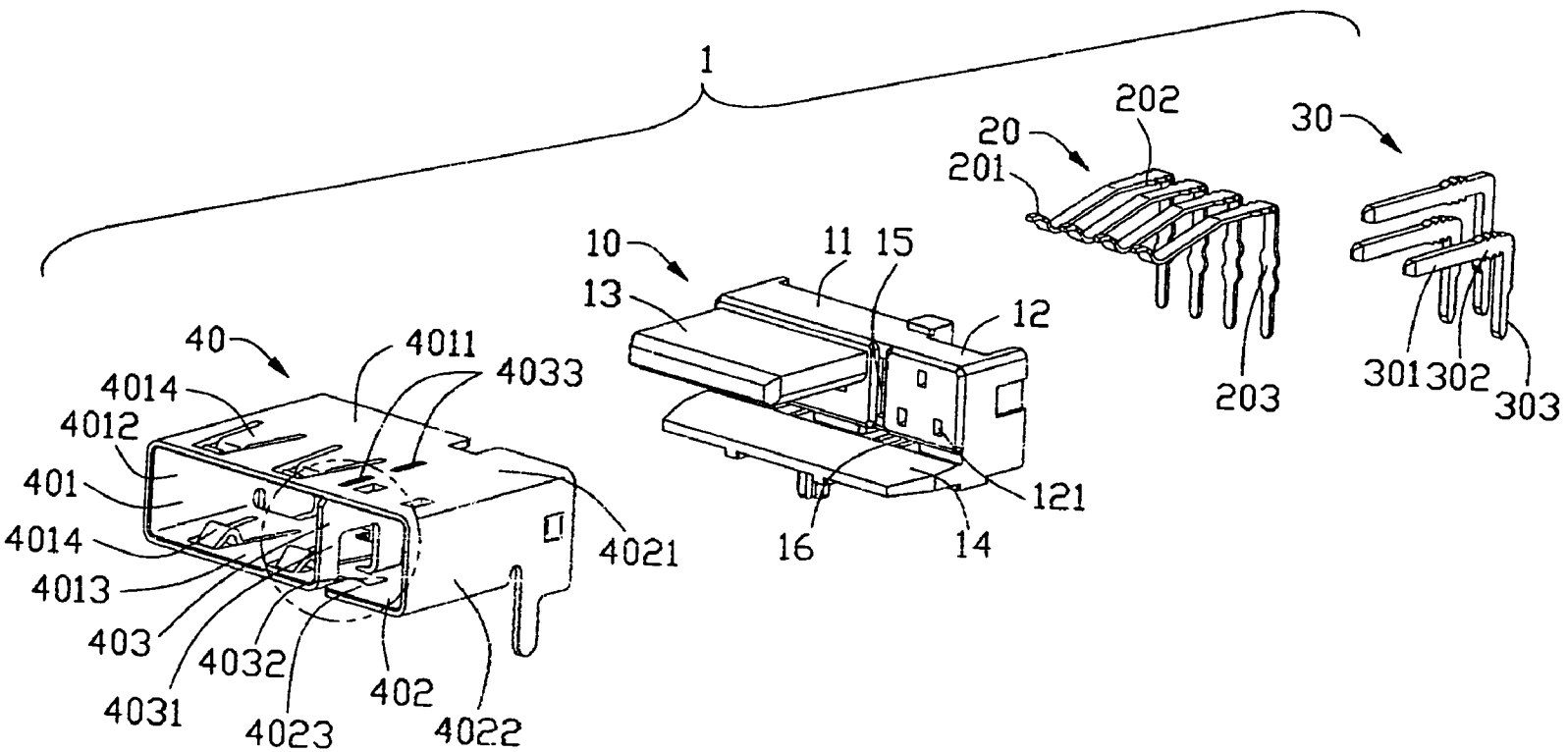
FIG. 4 is an exploded view of the electrical connector shown in FIG. 1.
Figure 5:
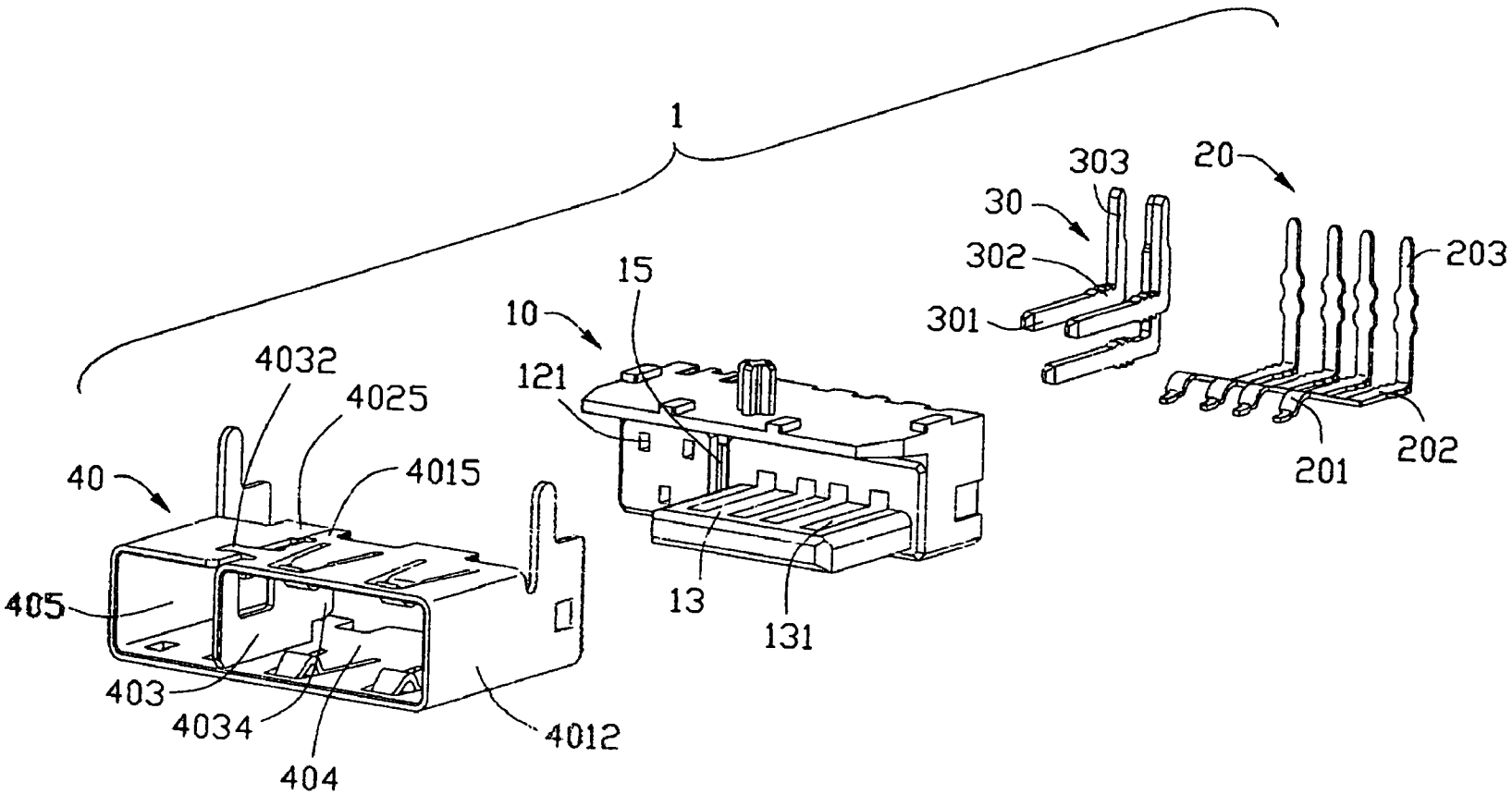
FIG. 5 is a second exploded view of the electrical connector shown in FIG. 2.
Figure 6:
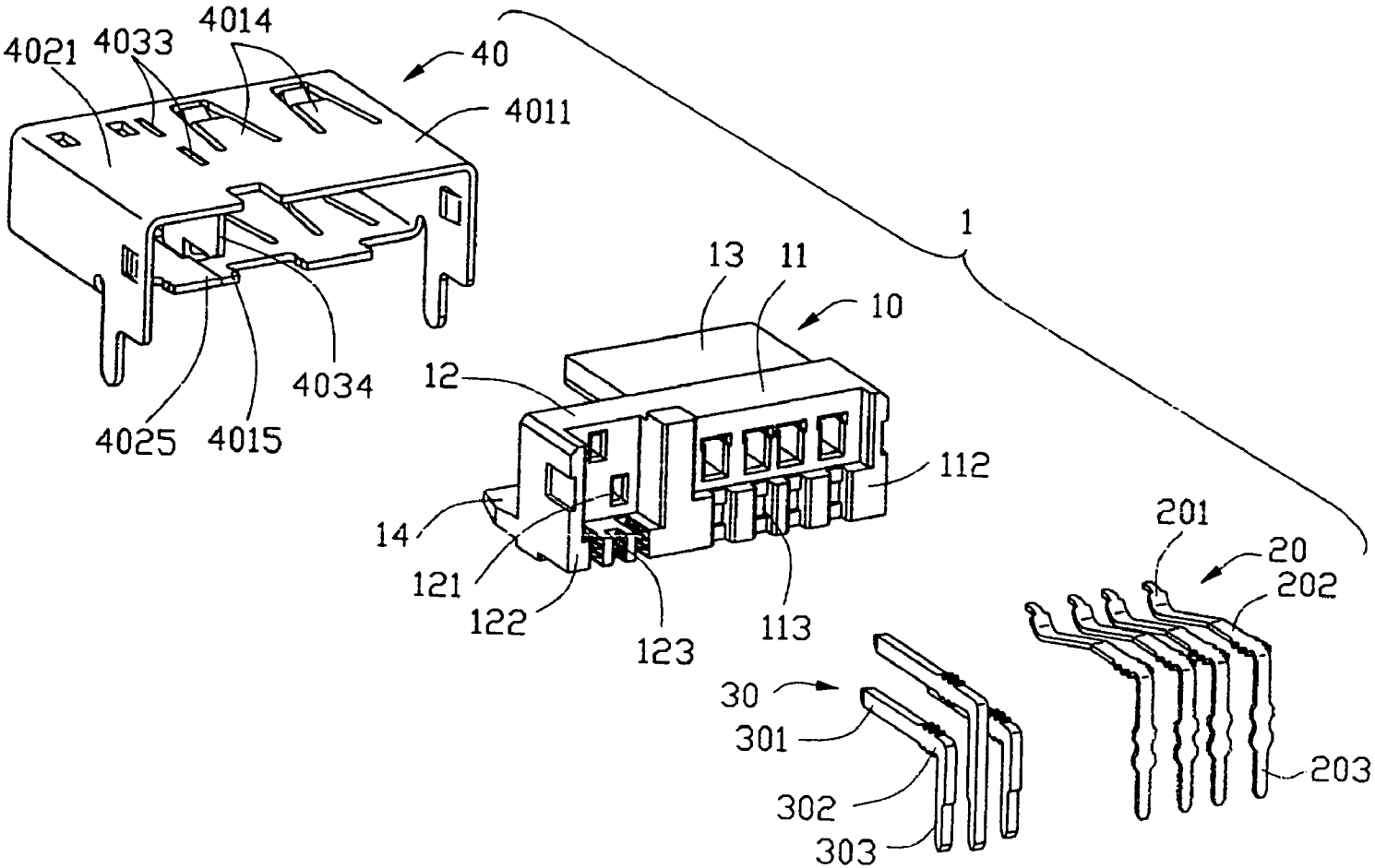
FIG. 6 is a third exploded view of the electrical connector shown in FIG. 3.
Figure 7:
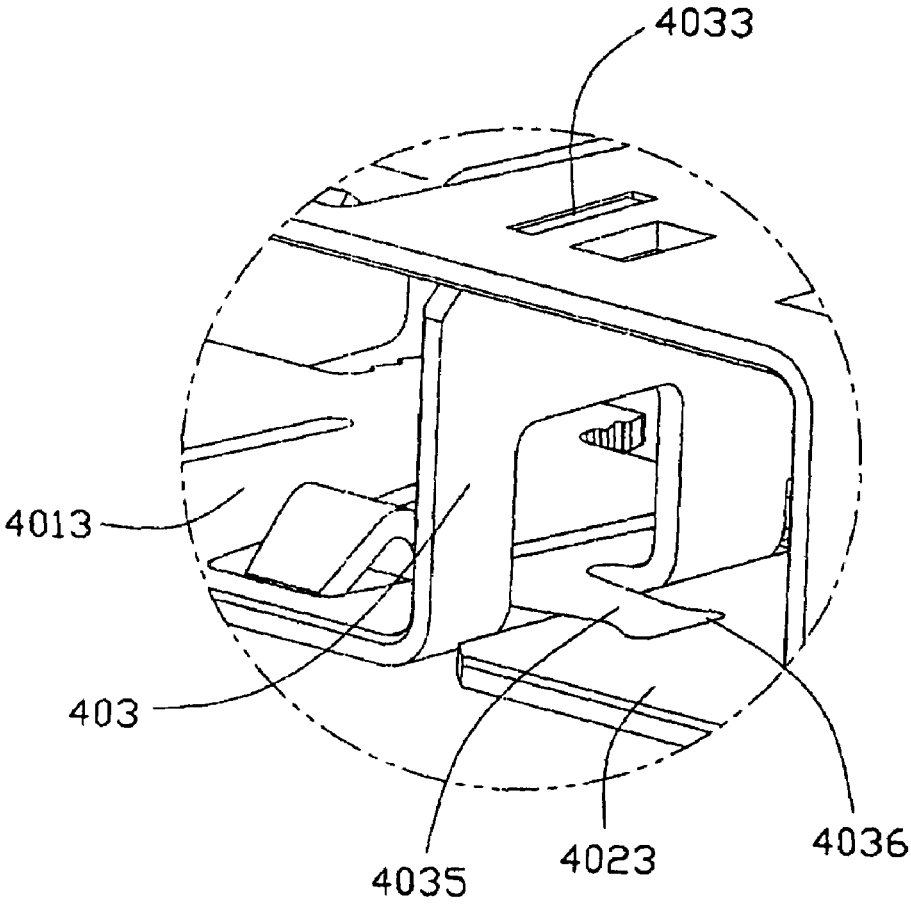
FIG. 7 is a partly enlarged view taken from the circle of FIG. 4.

Referring to FIGS. 4 to 6, the insulative housing 10 includes a first base 11, a second base 12 beside the first base 11, a tongue plate 13 integrally extending forwardly from the first base 11, and a retaining plate 14 extending forwardly from the bottom edge of the housing 10. A plurality of horizontal passageways 131 are disposed in a lower surface of the tongue plate 13 for receiving the first contacts 20 therein. The passageways 131 extend backwardly through the first base 11. The first base 11 further includes a rear wall 112 defining a plurality of first apertures 113 perpendicular to each passageway 131. The second base 12 includes a plurality of second through holes 121 parallel to the passageways 131. The through holes 121 are disposed in upper and lower rows for receiving the second contacts 30. The second base 12 includes a back wall 122 defining a plurality of second apertures 123 perpendicular to each through holes 121. A slit 15 is disposed between the first and second bases 11, 12 for engaging with the shield 40. The insulative housing 10 further includes a slot 16 disposed in communication of the retaining plate 14.

The first contacts 20 are assembled to the first base 11 from the rear wall 112. Each first contact 20 includes a first retaining portion 202, a first engaging portion 201 extending forwardly from the retaining portion 202, and a first soldering portion 203 perpendicularly bending from the retaining portion 202. The first engaging portions 201 are extending into the first chamber 404 for mating with a first mating connector (not shown).

The second contacts 30 are power contacts which are assembled to the corresponding second base 12 from the back wall 122. The second contacts 30 are pin shaped with big surface for transmitting high current. Each second contact 30 includes a second retaining portion 302, a horizontal second engaging portion 301 extending forwardly from the second retaining portion 302, and a second soldering portion 303 perpendicularly bending from the second retaining portion 302. The second engaging portions 301 are cantileveredly extending into the second chamber 405 for mating with a second mating connector (not shown).

Figure 8:
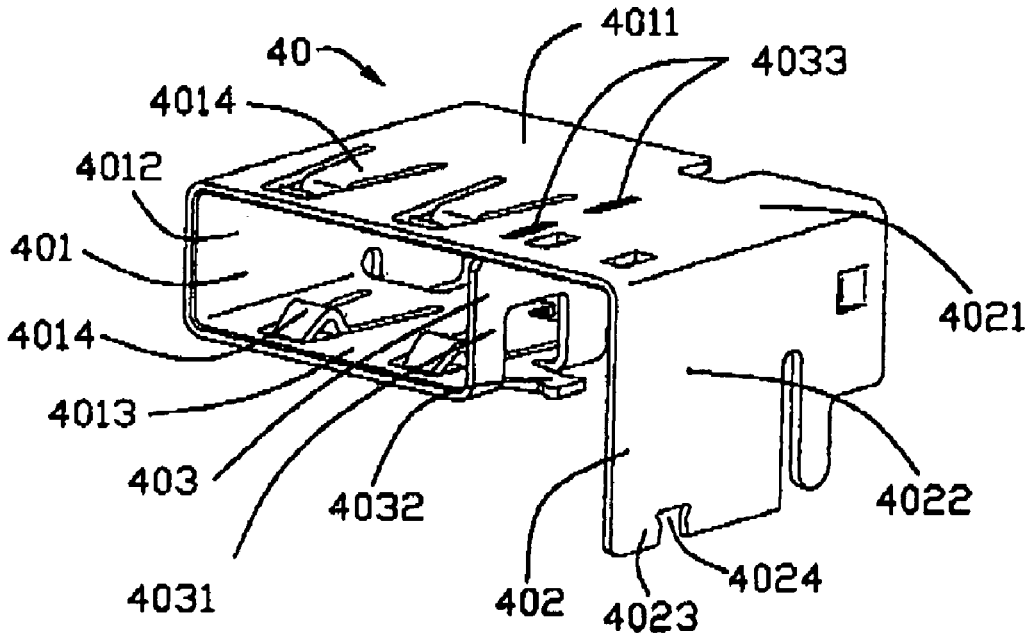
FIG. 8 is a perspective view of a metal shield of the electrical connector showing a fixing portion prior wedging into a mating slot.

The metal shield 40 is stamped from a metal sheet, which includes a partition wall 403 integrally formed with the metal shield 40. The first and second frames 401, 402 share the partition wall 403 and divide the metal shield into two pans. The first frame 401 includes a first top face 4011, first side face 4012 and the first bottom face 4013. The first top and bottom faces 4011, 4013 respectively include a pair of fingers 4014 extending inwardly into the first chamber 404 for mating with the first mating connector. The second frams 402 includes a second top face 4021 coplanar with the first top face 4011, a second side face 4022 and a second bottom face 4023 coplanar with the first bottom face 4013. The first and second side faces 4012, 4022 are integrally bending from the first and second cop faces 4011, 4021, respectively. The metal shield 40 further has a pair of holes (not labeled) between the first and second top faces 4011, 4021. The partition wall 403 includes a main portion 4031 and a fixing portion 4032 stamped from the main portion 4031. The main portion 4031 includes a pair of protrusions 4033 inserted into the holes formed in the upper face of the metal shield 40, so that the main portion 4031 can be fixed with said upper face. Besides, a rear tail 4034 is received in the slit 15. The fixing portion 4032 is substantially perpendicular to the main portion 4031. The second bottom face 4023 has a mating slot 4024 for fixing with the fixing portion 4032 as shown in FIG. 8. The mating slot 4024 is in corresponding configuration of the fixing portion 4032. The first bottom face 4013 has a first tab 4015 and the second bottom face 4023 has a second tab 4025 adjacent to the first tab 4015, wherein the first and second tabs 4015, 4025 are simultaneously received in the slot 16. The fixing portion 4032 has a middle portion 4035 smaller than the distal end portion 4036. Therefore, the second bottom face 4023 can be firmly connected to the partition wall 403 without horizontal movement therebetween. In this condition, the second frame 402 is stable for repeated insertion of a second mating connector (not shown).

Comparing with the prior art, the second frame 402 is more stable with the fixing portion 4032 wedged into the mating slot. Further more, first connector is a USB connector 50 and the second connector is a power connector 60 positioned side by side. Under this design, the power connector 60 can provide adscititious electric power in case that the electric power of the USB connector 50 is low. Therefore, the working stability of peripheral electrical device connected with the electrical connector 1 is improved.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

an insulative housing;

a plurality of contacts retained in the insulative housing; and a metal shield enclosing the insulative housing and comprising a first frame and a second frame, the first and second frames sharing a partition wall, the second frame having a bottom face defining a mating slot, the partition wall having a fixing portion wedged into the mating slot, wherein the fixing portion has a distal end portion and an intermediate portion in communication of the distal end portion, and wherein the intermediate portion is narrower than the distal end portion.

2. The electrical connector according to claim 1, wherein the first and the second frames are bended from a unitary one-piece metal sheet and disposed side by side.

3. The electrical connector according to claim 1, wherein the metal shield defines a hole, the partition wall having a protrusion received in the hole.

4. The electrical connector according to claim 1, wherein the fixing portion is stamped outwardly from a middle portion of the partition wall and perpendicular to the partition wall.

5. The electrical connector according to claim 1, wherein the first frame is rectangle shaped with a first top face, a first bottom face parallel to the first top face, a first side face and the partition wall, the partition wall extending integrally from the first bottom face.

6. The electrical connector according to claim 5, wherein the second frame has a second top face integral with the first top face.

7. The electrical connector according to claim 5, wherein the first bottom face of the first flame and the bottom face of the second frame are coplanar with each other.

8. The electrical connector according to claim 5, wherein the insulative housing defines a slot, the first bottom face of the first frame and the bottom face of the second frame respectively having first and second tabs simultaneously received the slot.

9. The electrical connector according to claim 1, wherein the partition wall has a rear tail received in a slit of the insulative housing.

10. The electrical connector according to claim 1, wherein a first single connector having the first frame is a USB connector.

11. The electrical connector according to claim 1, wherein a second single connector having the second frame is a power connector.

12. The electrical connector according to claim 1, wherein contacts comprise a plurality of pin shaped power contacts, each power contact having an engaging portion cantileveredly extending into the second frame.

13. An electrical connector, comprising:

an insulative housing;

a plurality of contacts retained in the insulative housing; and a unitary one-piece metal shield enclosing the insulative housing and defining a connector interface, the metal shield comprising a partition wall integrally extending from said metal shield, the partition wall extending into said connector interface to divide the connector interface into a first frame and a second frame, the first frame comprising a first top wall and a first bottom wall parallel to the first top wall, the second frame comprising a second top wall being integral with the first top wall and a second bottom wall opposite to the second top wall, wherein the second bottom wall defines a mating slot and to partition wall has a fixing portion received in the mating slot; wherein the first and second too walls of the metal shield define a hole, the partition wall having a protrusion received in the hole.

14. The electrical connector according to claim 13, wherein the fixing portion is stamped outwardly from a middle section of the partition wall.

15. The electrical connector according to claim 13, wherein the insulative housing defines a slot the first bottom wall of the first frame and the second bottom wall of the second frame respectively having a first and a second tabs simultaneously received the slot.

* * * * *